US006196490B1

(12) United States Patent
Gotoh et al.

(10) Patent No.: US 6,196,490 B1
(45) Date of Patent: Mar. 6, 2001

(54) ELASTIC YARN WINDER AND METHOD FOR USING SAME

(75) Inventors: Ryoji Gotoh, Ohtu; Hiroshi Fujita, Kusatsu, both of (JP)

(73) Assignee: Dupont Toray Co. Ltd., Tokyo (JP)

( * ) Notice: Subject to any disclaimer, the term of this patent is extended or adjusted under 35 U.S.C. 154(b) by 0 days.

(21) Appl. No.: 08/989,711

(22) Filed: Dec. 12, 1997

(51) Int. Cl.[7] ..... B54H 18/08

(52) U.S. Cl. ..... 242/476.1; 242/476.6; 242/486.2; 242/487.9

(58) Field of Search ..... 242/476.1, 476.6, 242/485.9, 486.2, 487.6, 487.9

(56) References Cited

U.S. PATENT DOCUMENTS

| | | | | |
|---|---|---|---|---|
| 4,313,576 | * | 2/1982 | Claret et al. | 242/476.1 |
| 4,351,492 | * | 9/1982 | Aoyama et al. | 242/476.1 |
| 4,646,981 | * | 3/1987 | Ohayon | 242/476.1 |
| 4,784,342 | * | 11/1988 | Matthies et al. | 242/476.1 |
| 6,027,063 | * | 2/2000 | Jaschke | 242/476.1 |

FOREIGN PATENT DOCUMENTS 2624345 6/1997 (JP) .

* cited by examiner

*Primary Examiner*—Donald P. Walsh
*Assistant Examiner*—Emmanuel M. Marcelo

(57) ABSTRACT

An elastic yarn winder for winding large-diameter elastic yarn packages onto a plurality of tubes without leaving broken yarn ends in the core of the packages is provided.

6 Claims, 6 Drawing Sheets

ELASTIC YARN WINDER AND METHOD FOR USING SAME

BACKGROUND

1. Field of the Invention

This invention relates to an elastic yarn winder for winding large-diameter elastic yarn packages onto a plurality of tubes without the elastic yarn crossing between the tubes and without broken yarn ends remaining in the inner layer ("core") portion of the elastic yarn package. This invention also relates to an elastic yarn transfer method for reliably transferring an incoming elastic yarn end from a full package to an empty tube.

2. Description of the Prior Art

Winders of the prior art are shown in FIGS. 4–6. These have hitherto been used for winding elastic yarns such as polyester, polyether, polyurethane and polyamide yarns, and for producing elastic yarn packages. The winder shown in FIG. 4 has, on a turnable table 15, a single spindle 11, a friction roll 12 that drives this spindle 11, a traverse mechanism 13 that traverses the yarn, and a traverse releasing mechanism 14 that removes the yarn from a traverse guide mounted in traverse mechanism 13. This winder is generally used for producing large-diameter elastic yarn packages having diameters up to 350 mm.

The above-mentioned turnable table 15 can turn only several degrees by hand about a rotating shaft. The single spindle 11 mentioned above is supported in a freely rotatable manner by the table 15, and a plurality of tubes 16 can be mounted on the spindle.

Friction roll 12 presses constantly against the layer of elastic yarn that has been taken up onto tube 16, and rotatably drives tube 16 in a clockwise direction.

A traverse guide (not shown) is provided on the above-described traverse mechanism 13. This traverse guide guides elastic yarn Y back-and-forth over the traverse range, so that traversing movement of the yarn is carried out. In addition, a plurality of yarn guides 19 are provided on top of traverse mechanism 13.

The prior art practices for taking up and transferring elastic yarn using the winder depicted in FIG. 4 are disclosed in FIG. 5, which is also of the prior art.

FIG. 5(1) shows the elastic yarn being taken up and a yarn package 18 being formed.

FIG. 5(2) shows that when elastic yarn package 18 has been fully wound, a plurality of continuously fed elastic yarns Y are drawn in by means of suction nozzle 20 on suction device 17, and separated from fully wound elastic yarn package 18. Table 15 is turned several degrees, thereby separating spindle 11 from the friction roll 12 and stopping rotation of the spindle. The fully wound elastic yarn package 18 mounted on the spindle 11 is then pulled off, following which an empty tube 16 is mounted in its place.

FIG. 5(3) shows first, the traverse releasing mechanism 14 being lowered so that the yarn is no longer traversing, and the spindle 11 on which an empty tube 16 has been replaced is once again pressed against the friction roll 12, thereby causing spindle 11 to rotate. Here, the plurality of elastic yarns Y that have been drawn in at the suction nozzle 20 are respectively grasped by a plurality of guides 19 provided at the top of traverse mechanism 13 and are drawn in by the suction device 17. This way, as indicated by the dashed line in the Figure, the elastic yarn Y passes between traverse mechanism 13 and friction roll 12. Afterwards, the suction nozzle 20 is rotated clockwise along the outer periphery of the single foremost empty tube 16 that has been mounted on spindle 11, thus winding the elastic yarn Y onto the single empty tube 16.

Elastic yarn Y, prior to entering the suction nozzle 20, is then forcibly stretched so that breakage of the elastic yarn occurs.

Next, the traverse releasing mechanism 14 that removes the elastic yarn Y from the traverse guide is returned to the original position, the elastic yarn Y is grasped by the traverse guide and traverse is begun, thereby completing the change in the elastic yarn Y.

These prior-art winders and method, however, have inherent disadvantages. When winding of the elastic yarn package 18 begins, as shown in FIG. 6 (also of the prior art), elastic yarn Y is first wound onto just the foremost hollow tube 16*a* that has been mounted on the spindle. Because the other elastic yarns Y (those not intended to be wound onto foremost tube 16*a*) have been grasped by guide 19 at the top of the traverse mechanism 13, the other elastic yarns Y are shifted to the positions of the respective empty tubes behind 16*a* by inertial force, at which positions they start being taken up onto their corresponding empty tubes 16. Therefore, during the interval between the beginning of take-up until the elastic yarn Y moves to the its proper corresponding tube 16 (by means of inertial force), the elastic yarn crosses between each of the tubes 16 further back and is taken up while passing each of the tubes.

When the packages are completed, at the time of yarn changing, the yarn is broken by forcible stretching of the elastic yarn and a contractile force acts upon the elastic yarn the moment that the yarn has broken. The direction of the contractile force of the elastic yarn Y becomes random and indeterminate, as a result of which the yarn end at which winding begins (the incoming cut end) can reach the traversing regions of the neighboring elastic yarn packages and become entangled in the neighboring tubes. The yarn end at which winding begins can also fly out from the sidewall of the fully or partially wound elastic yarn package and become entangled with other equipment.

Thus, utilizing prior art winders, elastic yarn can cross between each of the tubes at the initial winding stage (when the fully wound elastic yarn package is removed from the winder spindle) and the fully wound packages will be connected to each other by the crossed elastic yarn Y. In order to separate the packages, the crossing yarns must be cut. In addition, a further problem arises because the elastic yarns that crossed between each of the tubes are cut between the packages; that is, the pieces of yarn that have been cut remain at the interior of the foremost package.

As a result, yarn breakage will occur at users of common elastic yarn packages, resulting in reduced quality and commercial value of the elastic yarn. For these reasons, improved equipment and methods which avoid the creation of these cut ends have been long sought.

Japanese Registered Patent No. 9-2624345 (1997) discloses winders that produce elastic yarn packages having a relatively small (less than 170 mm) diameter. Here, because two spindles are provided on a turnable table and yarn transfer is carried out by turning of these two spindles, the yarn at the beginning of winding is not disposed so as to cross between the tubes. However, in this case, the diameter of the fully wound package is restricted by the distance between the spindle at the winding position and the spindle at the waiting position. This makes it difficult to produce large-diameter elastic yarn packages with winding diameters greater than approximately 250 mm. Therefore, either a winder having only one spindle needs to be used for the production of such packages or, alternatively, one must greatly widen the distance between the two spindles on an existing winder entailing enormous costs, comparable to the cost of producing a new winder.

Therefore, in prior-art winders and yarn transfer methods, there are limits on the efficient production of large-diameter elastic yarn packages which do not cause crossing of the elastic yarn between the individual tubes, leaving cut pieces of yarn in the interior layers of the package, and without letting the winding startup yarn ends fly off from the sidewalls of the elastic yarn package.

SUMMARY OF THE INVENTION

The winder of the present invention for winding a plurality of elastic yarns to form wound packages comprises:

- a freely rotatable spindle mounted on a turntable, the spindle having an axis and being capable of having mounted thereon a plurality of tubes, each tube having an axis, a length, a longitudinal center, and a yarn-catching tube groove in its periphery;
- a driven friction roll which can be urged against the tubes so that the tubes and spindle are rotated by the friction roll;
- a plurality of fixed yarn guides corresponding to the plurality of yarns; and
- a yarn transfer guide assembly comprising
  - a shaft rotatably mounted on the winder adjacent to and coaxial with the friction roll;
  - an arm having a first end and a second end and being mounted on the shaft at the first end;
  - a yarn control plate fixedly mounted on the second end of the arm, the plate having a shaped edge and the edge having a center;
  - a plurality of yarn control guides in the shaped edge, the guides corresponding to the plurality of yarns;
  - a plurality of fixed blades corresponding to the plurality of yarn control guides, each fixed blade being mounted adjacent to each yarn control guide;
  - a lever slidably mounted on the plate adjacent to the yarn control guides; and
  - a plurality of movable blades attached to the lever and the plate so that when the lever is slid, each blade passes a corresponding yarn control guide and is urged against a corresponding fixed blade; each fixed yarn guide, tube groove, and yarn control guide defining an imaginary plane substantially perpendicular to the axis of the spindle.

The method of the present invention for manually transferring a plurality of elastic yarns during the formation of wound packages comprises the steps of (A) guiding the yarns through a plurality of fixed yarn guides;

around a driven friction roll;

around a plurality of tubes corresponding to the plurality of yarns, each tube having an axis, a length, and a yarn-catching groove cut into its periphery, and being mounted on a freely rotating spindle; and across a yarn control plate having a shaped edge, wherein the tension on the yarns is sufficient to make them slide into a plurality of yarn control guides in the edge; and between a plurality of movable blades and a plurality of fixed blades; and (B) cutting the yarns by activation of the movable blades, wherein the distance between the plate edge and the axis of the tubes is no more than one-half the length of each of the tubes.

DETAILED DESCRIPTION OF THE INVENTION

Figure 1:
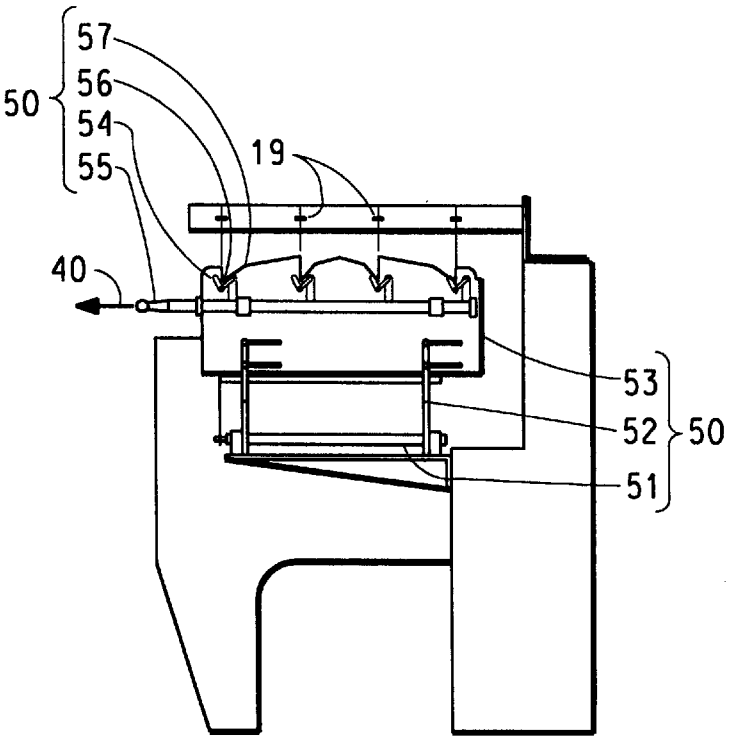
FIG. 1(1) is a front view showing one embodiment of an elastic yarn winder of the present invention, and FIG. 1(2) is a side view of the same embodiment.
Figure 1:
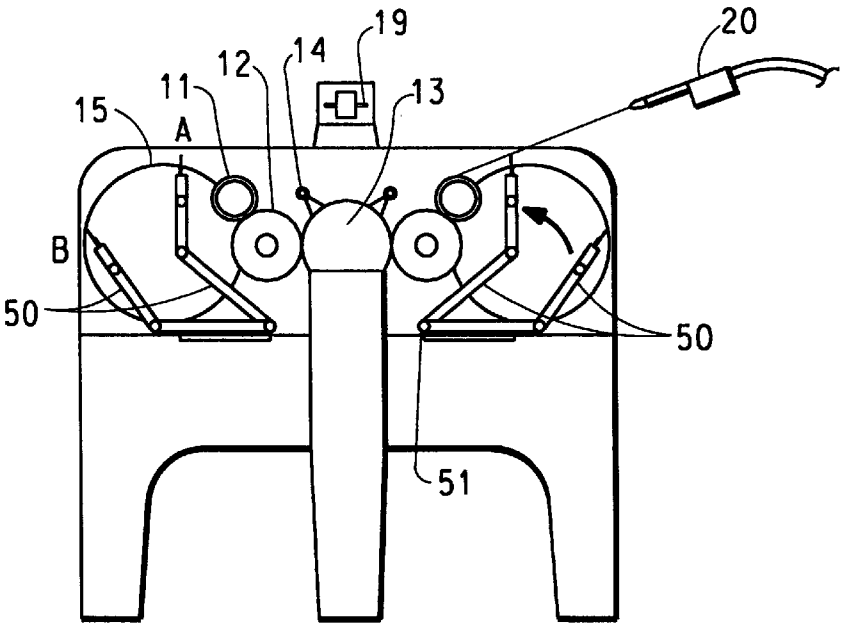
Figure 2:
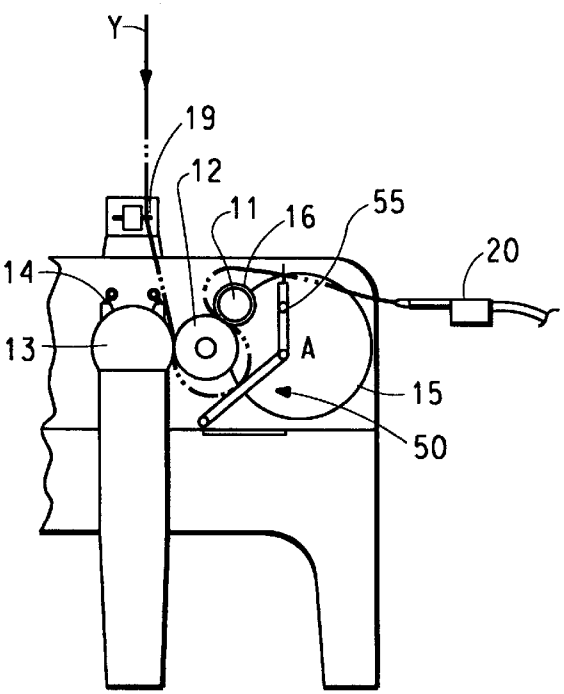
FIGS. 2(1)–(3) are front views illustrating in steps the manner in which yarn transfer is carried out using the elastic yarn winder of the present invention.
Figure 2:
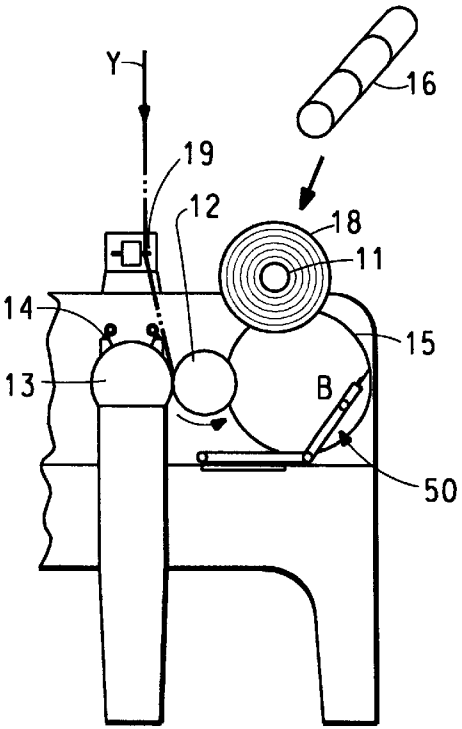
Figure 2:
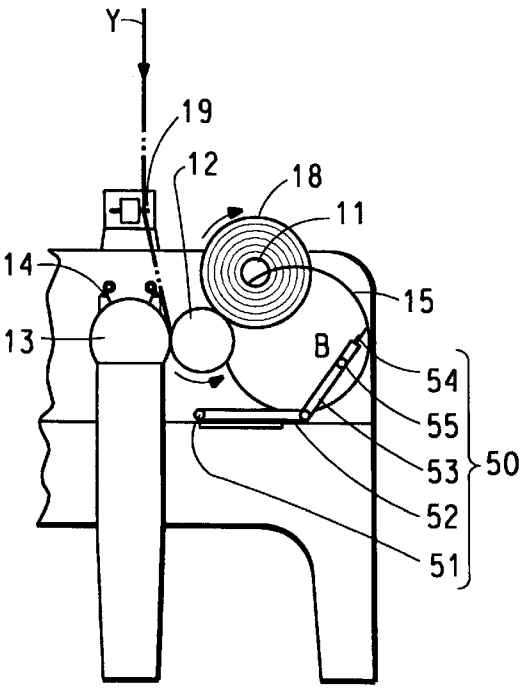
Figure 7:
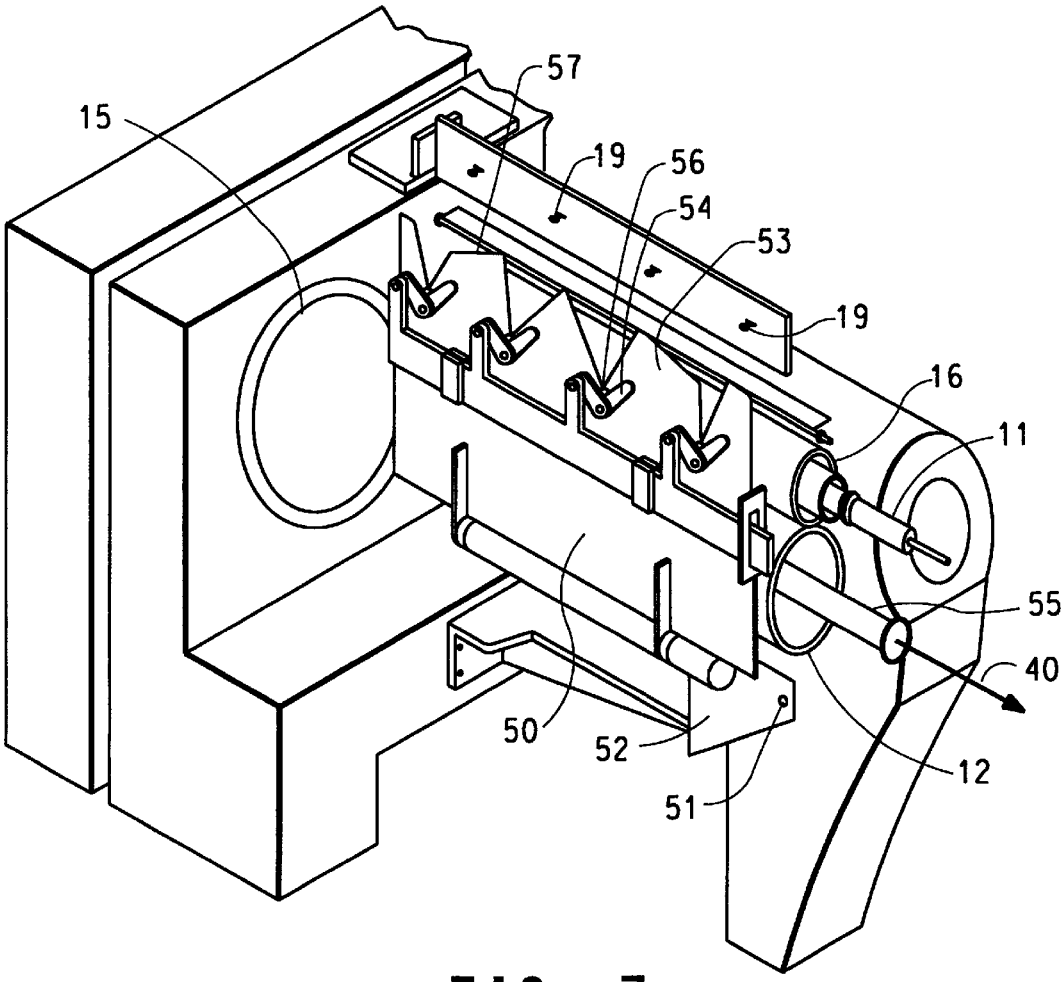
FIG. 7 is an isometric view of the winder of the present invention.

As illustrated in FIGS. 1, 2, and 7, the elastic yarn winder of the present invention comprises yarn guides 19, turntable 15, freely rotatable spindle 11 mounted on the turntable and capable of having a plurality of tubes 16 mounted on it, friction roll 12 that presses against and drives the tubes, traverse means 13 comprising a plurality of traverse guides (not shown) that carry out the traversing of elastic yarn Y, a traverse releasing means (not shown) that removes the elastic yarn from the traverse guide, and yarn transfer means 50 that guides the elastic yarn at the start of winding into a groove 16' (see FIG. 3) provided beforehand in the periphery of each tube and cuts the yarn to complete the transfer.

Yarn transfer means 50 comprises shaft 51 rotatably mounted at a suitable place on the winder, arm 52 mounted on shaft 51, yarn control plate 53 fixedly mounted on the end of arm 52, and cutter 54 and lever 55 mounted on plate 53. Plate 53 has cut therein a plurality of yarn control guides 56. Cutter 54 comprises a blade, preferably a fixed blade or cutting surface and a movable blade, the movable blade being slidably attached to lever 55, which can be pulled by an operator in a direction axially parallel to spindle 11 (arrow 40 in FIGS. 1 (2) and 7) in order to activate the movable blade and cut the yarn. It is within the scope of the present invention that with minor alterations to the design of the blades and lever, such alterations being readily apparent to those of ordinary skill in the art, the lever could be pushed in order to cut the yarns. However, pulling is preferred for improved safety to the hands of the operator. The yarn control plate also has a shaped edge 57 that leads each yarn into its proper control guide 56 and in position for being caught by tube groove 16' (see FIG. 3). It is preferred that shaped edge 57 be symmetrical about the center of transfer means 50, with the edge of each edge section sloping away from the center, as shown in FIG. 1 (2). When edge 57 is thus symmetrical and the yarns are led across the center of the edge, the angle the yarns make from guides 19 is reduced on average (see FIG. 3), and the yarns more readily slip into the proper control guide 56. This leads to more reliable yarn transfer.

For each of the elastic yarns Y, yarn guide 19, tube groove 16', and guide 56 are in substantially the same imaginary plane, which is substantially perpendicular to the axis of the spindle. Although the Figures illustrate the invention with four yarns, any suitable number of yarns can be wound with the apparatus and by the method of the present invention.

Figure 3:
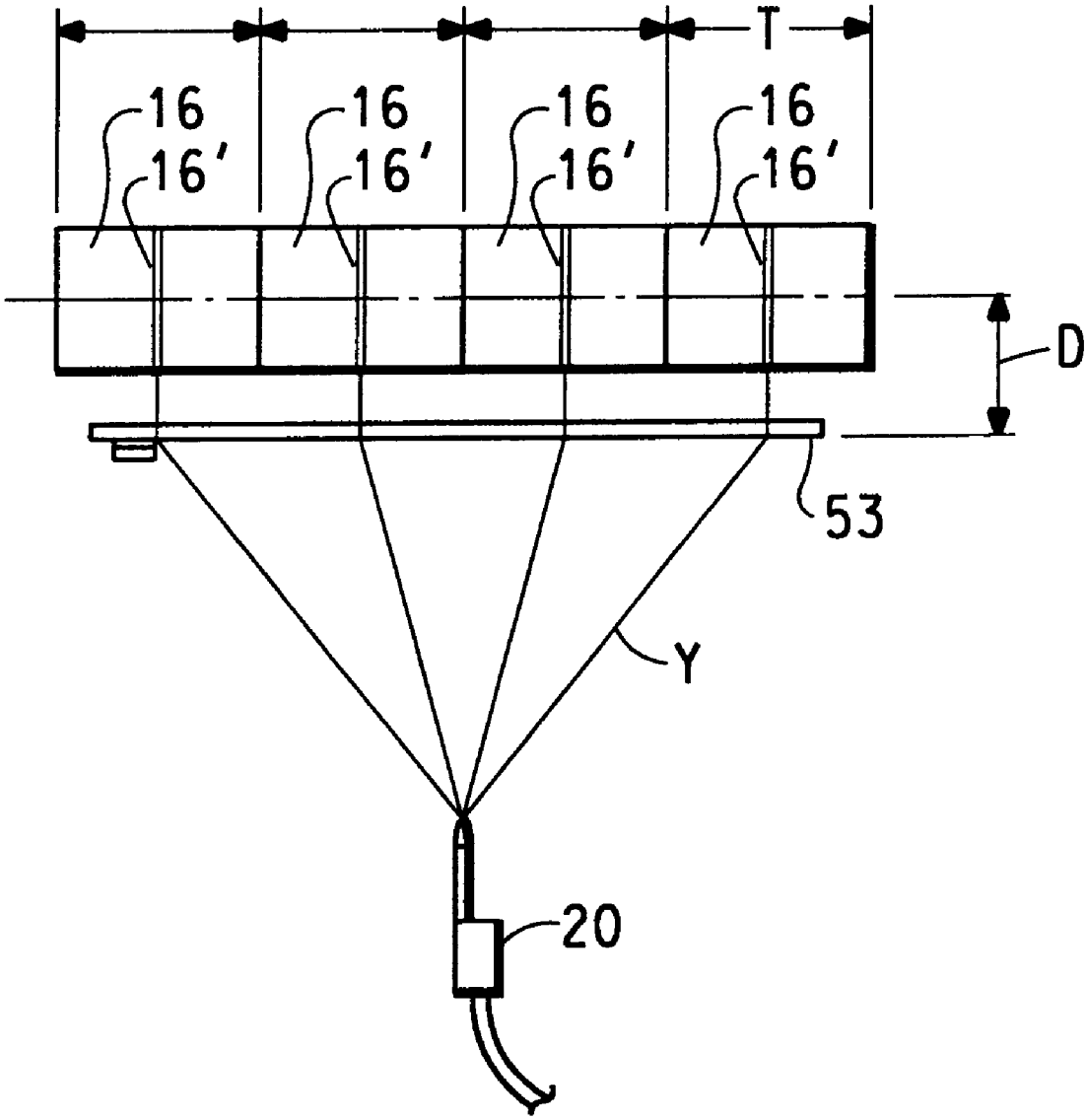
FIG. 3 is a top view of the present invention showing the relationship between the tubes, yarn, yarn guides, and transfer means during yarn transfer.
Figure 4:
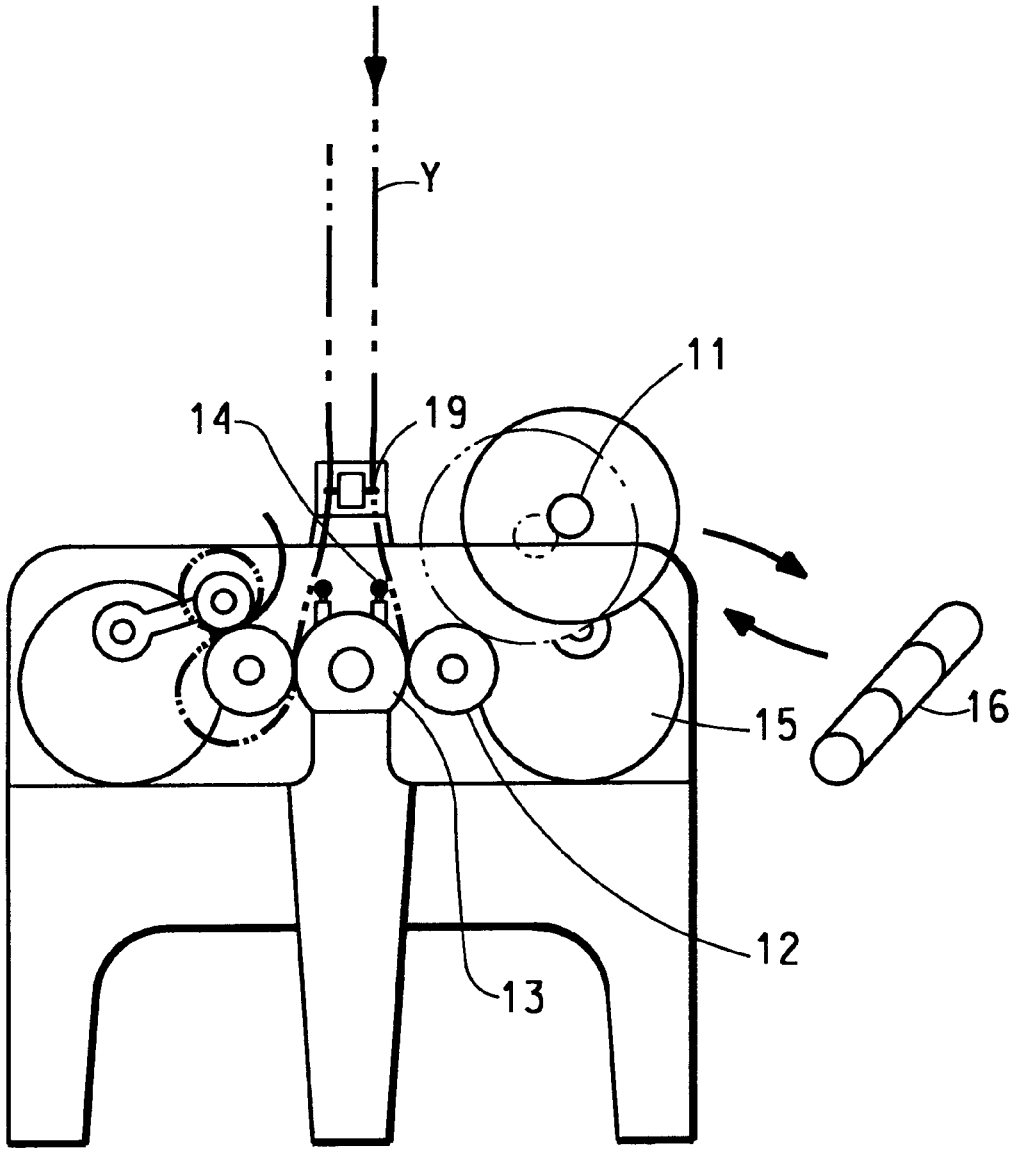
FIG. 4 (PRIOR ART)
FIG. 4 is a front view of an elastic yarn winder of the prior art.
Figure 5:
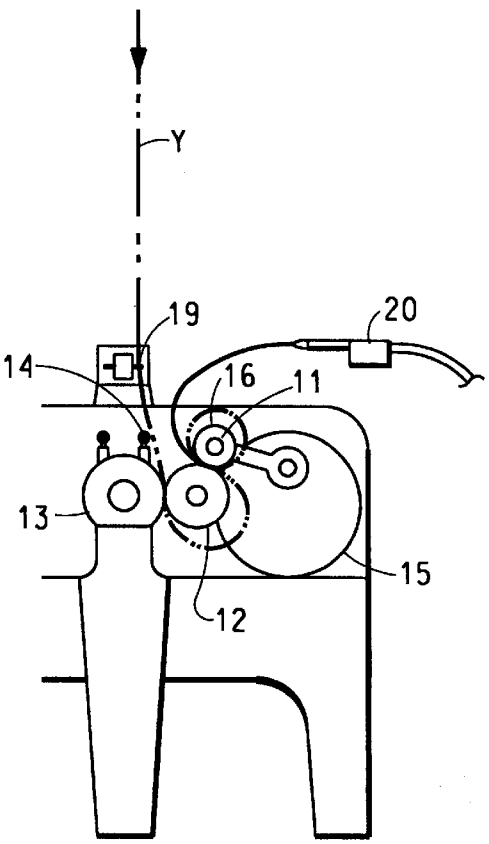
FIG. 5(3) (PRIOR ART)
FIGS. 5(1)–(3) are front views illustrating the steps of yarn transfer using an elastic yarn winder of the prior art.
Figure 5:
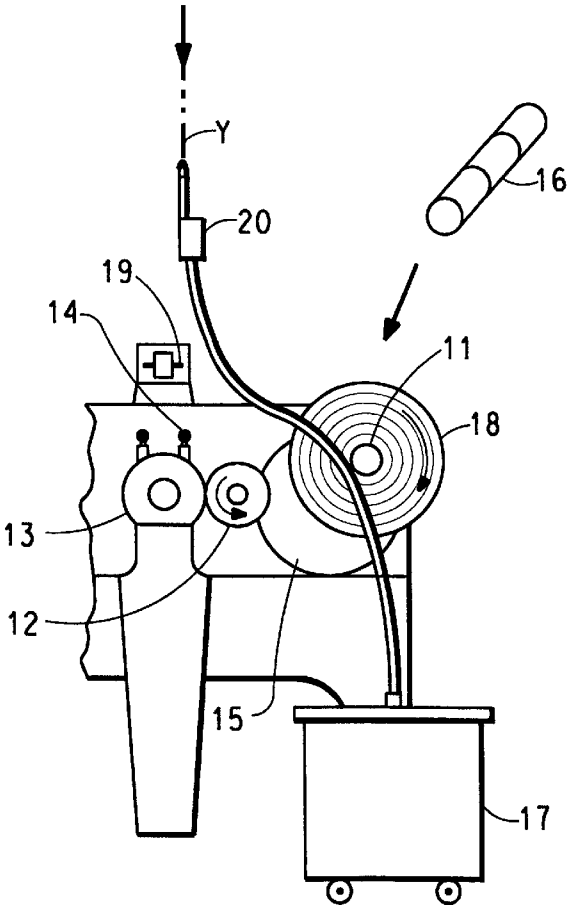
FIG. 5(2) (PRIOR ART)
Figure 5:
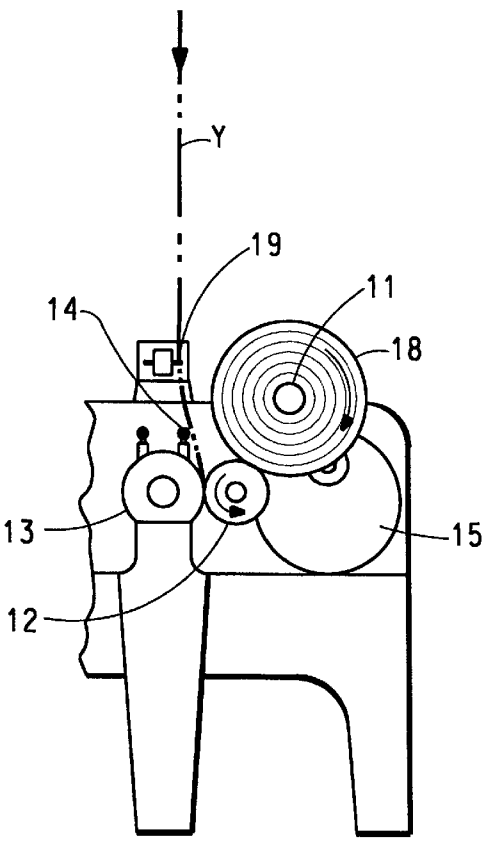
FIG. 5(1) (PRIOR ART)
Figure 6:
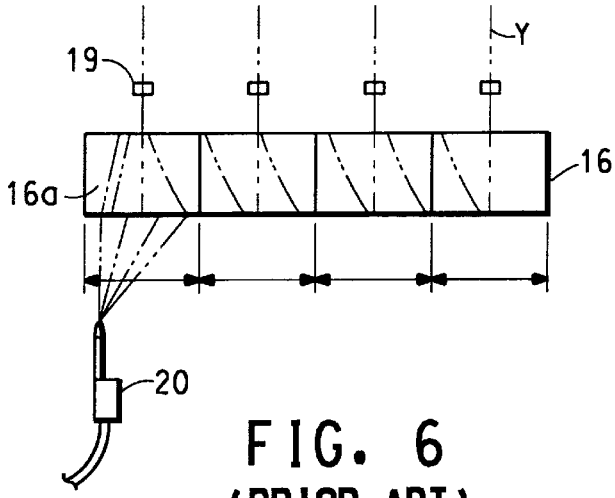
FIG. 6 (PRIOR ART)
FIG. 6 is a top view showing the relationship between the tubes, yarn ends, and yarn guides at the time of yarn transfer of the prior art.

As shown in FIG. 3, it is also preferred that the grooves 16' be in the longitudinal center of tubes 16 and that the distance D between plate 53 and the axis of tubes 16 when transfer means 50 is in working position A (FIG. 2) be no more than half the length T of each of the tubes. Under these conditions, the length of the yarn between the tube groove and the free, cut end will too short to become entangled with a neighboring tube or yarn.

In FIGS. 1 and 2, yarn transfer means 50 is shown in two positions: working position A and waiting position B. Position A is the state during transfer, and position B is the normal state during winding.

The winder of the present invention can be used for winding elastic yarn in the range of about 420 and 1680 denier (about 465 decitex to about 1865 decitex) to give a wound package holding 1.5 kg of yarn and more, though smaller packages can be wound if desired. The wound package diameter is in the range of about 150 mm to 350 mm.

Operation of yarn transfer means 50 of the present invention is explained below while referring to FIGS. 2(1)–(3) and 3.

Using suction nozzle 20, the operator manually interrupts the approach of yarn Y to the winder and separates the incoming yarn from fully wound elastic yarn package 18. Turntable 15 is rotated several degrees to remove wound package 18 from contact with friction roll 12. A brake is applied and rotation of package 18 is stopped. Wound package 18 is removed from spindle 11, and empty tube 16 is mounted on the spindle.

Traverse release means 14 is lowered so that the traverse guide cannot traverse the incoming yarn. The turntable is returned to the winding position so that tube 16 is brought into contact with friction roll 12 and begins to rotate, and transfer means 50 is moved from waiting position B to working position A. Still using suction nozzle 20, the operator manually guides yarn Y between friction roll 12 and spindle 11 and over approximately the center of edge 57 of yarn control plate 53. Tension on the yarn makes it slide into yarn control guide 56.

Lever 55 can be pulled by the operator in the direction of arrow 40, thereby moving the movable blade of the cutter 54 and forcibly cutting elastic yarn Y.

After the elastic yarn is cut, it retracts and bites into tube groove 16' by means of the frictional forces between the elastic yarn Y and the tube 16, and the yarn begins to be wound about the tube. Traverse release means 14 is raised so that the traverse guide begins to traverse the incoming yarn along the length of the tube. The yarn transfer operation is then completed by lowering the yarn transfer means 50 to waiting position B.

Because the yarn guides 19, tube grooves 16', and yarn control guides 56 define imaginary planes which are located preferably substantially in the center of each of the tubes, there is little likelihood that the cut yarn end will become entangled in neighboring yarns or tubes. Yarn transfer efficiency is markedly increased.

As a result of this invention, large-diameter (150 to 350 mm) wound packages of elastic yarn can be efficiently wound up without elastic yarns crossing between neighboring tubes and without leaving cut pieces of yarn within the inner layers of the packages. Because there is no need to cut elastic yarns that have crossed between the tubes, the working efficiency is greatly improved. In addition, no yarn ends project from the sidewalls, thereby making it possible to obtain elastic yarn packages having an excellent shape and quality.

What is claimed is:

1. A winder for winding a plurality of elastic yarns comprising:

a freely rotatable spindle mounted on a turntable, the spindle having an axis and being capable of having mounted thereon a plurality of tubes, each tube having an axis, a length, a longitudinal center, and a yarn-catching tube groove in its periphery;

a driven friction roll which can be urged against the tubes so that the tubes and spindle are rotated by the friction roll;

a plurality of fixed yarn guides corresponding to the plurality of yarns; and a yarn transfer guide assembly comprising a shaft rotatably mounted on the winder adjacent to and coaxial with the friction roll;

an arm having a first end and a second end and being mounted on the shaft at the first end;

a yarn control plate fixedly mounted on the second end of the arm, the plate having a shaped edge and the edge having a center;

a plurality of yarn control guides in the shaped edge, the guides corresponding to the plurality of yarns;

a plurality of fixed blades corresponding to the plurality of yarn control guides, each fixed blade being mounted adjacent to each yarn control guide;

a lever slidably mounted on the plate adjacent to the yarn control guides; and a plurality of movable blades attached to the lever and the plate so that when the lever is slid, each blade passes a corresponding yarn control guide and is urged against a corresponding fixed blade; each fixed yarn guide, tube groove, and yarn control guide defining an imaginary plane substantially perpendicular to the axis of the spindle.

2. The winder of claim 1 wherein the shaped edge s symmetrical about its center, and each wound package as a diameter of 150–350 mm.

3. The winder of claim 2 wherein each tube groove is at the longitudinal center of each tube, and upon rotation of the shaft the yarn control plate can approach the tubes so that the distance between the plate edge and the axis of the tubes is no more than one-half the length of each of the tubes.

4. The winder of claim 3 wherein the elastic yarn has a yarn size in the range of about 465 to 1865 decitex, and the resulting wound package weight is at least 1.5 kg.

5. A method for manually transferring a plurality of elastic yarns during the formation of wound packages comprising the steps of (A) guiding the yarns through a plurality of fixed yarn guides;

around a driven friction roll;

around a plurality of tubes corresponding to the plurality of yarns, each tube having an axis, a length, and a yarn-catching groove cut into its periphery, and being mounted on a freely rotating spindle; and across a yarn control plate having a shaped edge, wherein the tension on the yarns is sufficient to make them slide into a plurality of yarn control guides in the edge; and between a plurality of movable blades and a plurality of fixed blades; and (B) cutting the yarns by activation of the movable blades, wherein the distance between the plate edge and the axis of the tubes is no more than one-half the length of each of the tubes.

6. The method of claim 5 wherein the elastic yarn has a yarn size in the range of about 465 to 1865 decitex, the resulting wound package weight is at least 1.5 kg, and the diameter of each wound package is in the range of about 150 mm–350 mm.

* * * * *